US006311699B1

(12) United States Patent
Horman

(10) Patent No.: US 6,311,699 B1
(45) Date of Patent: Nov. 6, 2001

(54) PONYTAIL HOLDER

(75) Inventor: Heidi C. Horman, Mattapoisett, MA (US)

(73) Assignee: Remedies Trading Corporation, MA (US)

( * ) Notice: Subject to any disclaimer, the term of this patent is extended or adjusted under 35 U.S.C. 154(b) by 0 days.

(21) Appl. No.: 09/716,674

(22) Filed: Nov. 20, 2000

Related U.S. Application Data

(63) Continuation-in-part of application No. 09/452,791, filed on Dec. 2, 1999, now abandoned.

(51) Int. Cl.[7] ..... A45D 8/22

(52) U.S. Cl. ..... 132/278; 132/273; 132/275; 132/276

(58) Field of Search ..... 132/273, 275, 132/276, 277, 278, 279, 212, 245

(56) References Cited

U.S. PATENT DOCUMENTS

| | | | | |
|---|---|---|---|---|
| 649,848 | | 5/1900 | Koenig . | |
| 717,499 | * | 12/1902 | Gouy | 132/275 |
| 971,519 | | 10/1910 | Brannen . | |
| 1,864,199 | | 6/1932 | Kahn . | |
| 2,209,697 | | 7/1940 | Kislingbury . | |
| 2,403,601 | | 7/1946 | Jackson . | |
| 2,661,748 | | 12/1953 | Racho . | |
| 2,793,644 | * | 5/1957 | Todfield | 132/278 |
| 2,897,825 | | 8/1959 | Wagner . | |
| 2,975,788 | | 3/1961 | Ardelyan . | |
| 2,977,960 | | 4/1961 | Cattermole . | |
| 3,590,830 | | 7/1971 | Hannum . | |
| 3,662,767 | | 5/1972 | Murtha . | |
| 3,698,403 | | 10/1972 | Morand . | |
| 4,554,934 | * | 11/1985 | Mooneyhan | 132/245 |
| 4,671,302 | | 6/1987 | Hill . | |
| 5,082,011 | * | 1/1992 | Wu | 132/273 |
| 5,228,465 | | 7/1993 | Hill . | |
| 5,396,912 | | 3/1995 | Chou . | |
| 5,477,870 | | 12/1995 | Menaged . | |
| 5,520,201 | | 5/1996 | Hart . | |
| 5,535,765 | | 7/1996 | Takashima . | |
| 5,590,668 | | 1/1997 | Macy . | |
| 5,937,867 | * | 8/1999 | Williams | 132/275 |
| 5,996,593 | | 12/1999 | Horman . | |
| 6,089,240 | | 7/2000 | Chang . | |

FOREIGN PATENT DOCUMENTS

| | | | | |
|---|---|---|---|---|
| 370792 | * | 3/1923 | (DE) | 132/278 |
| 296 21 861 U 1 | | 3/1997 | (DE) . | |
| 1 566 678 | | 3/1968 | (FR) . | |
| 2481 897 | | 11/1981 | (FR) . | |
| 2 523 421 | | 3/1982 | (FR) . | |
| 2 207 047 A | | 1/1989 | (GB) . | |

* cited by examiner

*Primary Examiner*—Pedro Philogene

(57) ABSTRACT

A ponytail holder includes a hinged pair of first and second arms with first and second opposed elastic slings bridging respective arms. The arms have inner surfaces. When the ponytail holder is closed on a bunch of hair, the arms form a substantially cylindrical shape, and opposed elastic slings extend to accommodate the thickness of the bunch of hair. Fastening device are provided for releasably fastening the arms in a closed position. First and second non-slip rubber-type formations define first and second elastic slings respectively. Each elastic sling has a non-slip gripping surface. First and second elastic slings are supported at each end to bridge first and second inner surfaces, respectively.

16 Claims, 7 Drawing Sheets

SECTION AA

PONYTAIL HOLDER

This application is a continuation-in-part application that claims priority to application Ser. No. 09/452,791, filed Dec. 2, 1999 now abandoned.

TECHNICAL FIELD

This invention relates generally to hair accessories, and more particularly to a clamp that securely grasps and holds fine hair in place.

BACKGROUND

During the seventeen years that the inventor has been a hair stylist, she has received many complaints from her clients who have been unable to find a barrette or ponytail holder that will securely grasp and hold fine hair in place. This is true for adults with fine hair, but more so for children's extremely fine hair. Fine hair has a tendency to slip through the clamping arms, so people with fine hair need to reposition their ponytail holders frequently.

SUMMARY OF INVENTION

A ponytail holder includes a hinged pair of first and second arms with at least one elastic sling bridging at least one arm. In a preferred embodiment, the ponytail holder includes a hinged pair of first and second arms with first and second opposed elastic slings bridging respective arms. When the ponytail holder is closed on a bunch of hair, the rounded arms form a substantially cylindrical shape, and the slings extend to accommodate the thickness of the bunch of hair. Fastening means are provided for releasably fastening the arms in a closed position. First and second non-slip rubber-type formations define first and second elastic slings respectively, each sling having a non-slip gripping surface. First and second slings are supported at each end to bridge inner surfaces of first and second arms, respectively.

Each non-slip rubber-type formation includes an elastic sling portion, and a curved supporting portion, the formation defining a D-shaped aperture between the elastic sling portion and the supporting portion. Each formation is formed as one piece. Each inner surface includes two retaining walls for retaining a curved portion. The gripping surface defines a row of triangular shaped non-slip rubber-type teeth. Each tooth has two faces and a pointed linear apex. Each face and each apex is transverse to the clamping portion. The teeth of the first formation are in an offset interlocking mating relationship with the teeth of the second formation. A thin bunch of hair is interlock-gripped between mating faces of opposed formations. A thick bunch of hair is squeeze-gripped between adjacent faces of one formation. The ponytail holder accommodates a wide range of bunch thickness.

In another embodiment each formation is an elongate structure defining the elastic sling, and the ends of each sling are attached to a hinged end and an opposite end to bridge an inner surface. In this embodiment each sling is formed as a curved structure, and each sling is held in tension across an inner surface.

In another embodiment the ponytail holder includes a foam cushion located between each formation and its associated inner surface.

In another embodiment a single formation defines two elastic sling portions.

In another embodiment the ponytail holder includes one elastic sling portion bridges the inner surfaces of both arms.

In another embodiment the ponytail holder is a barrette-style ponytail holder.

DETAILED DESCRIPTION

Figure 1:
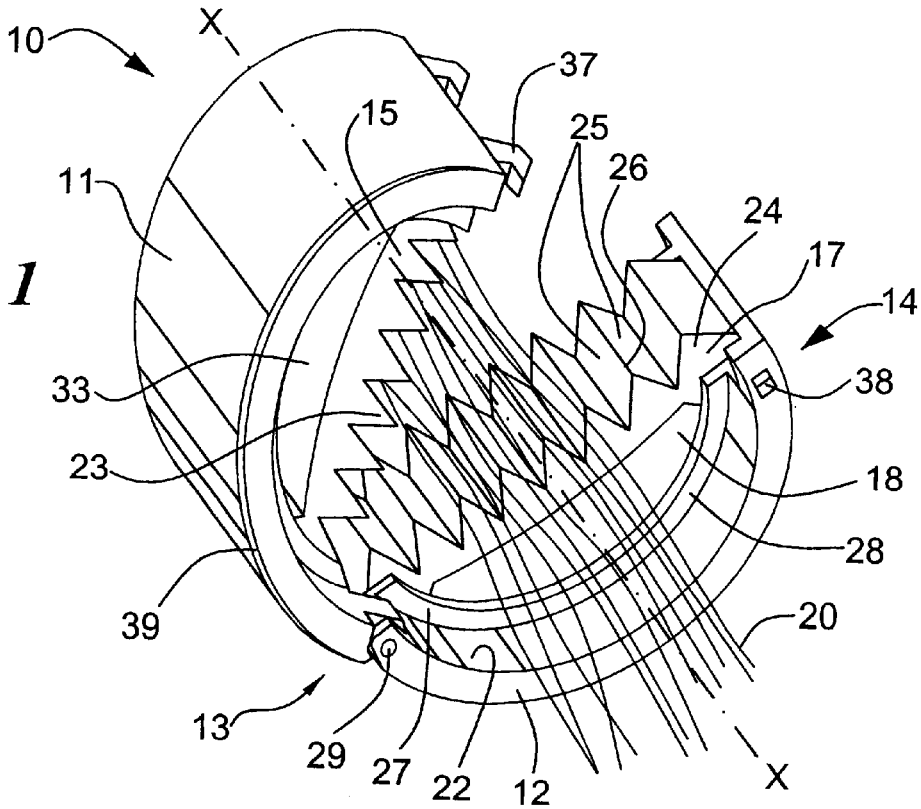
FIG. 1 is a perspective view in the open condition of a first preferred embodiment of a ponytail holder according to the present invention, the ponytail holder having two formations, each formation defining a shaped aperture and an elastic sling.
Figure 2:
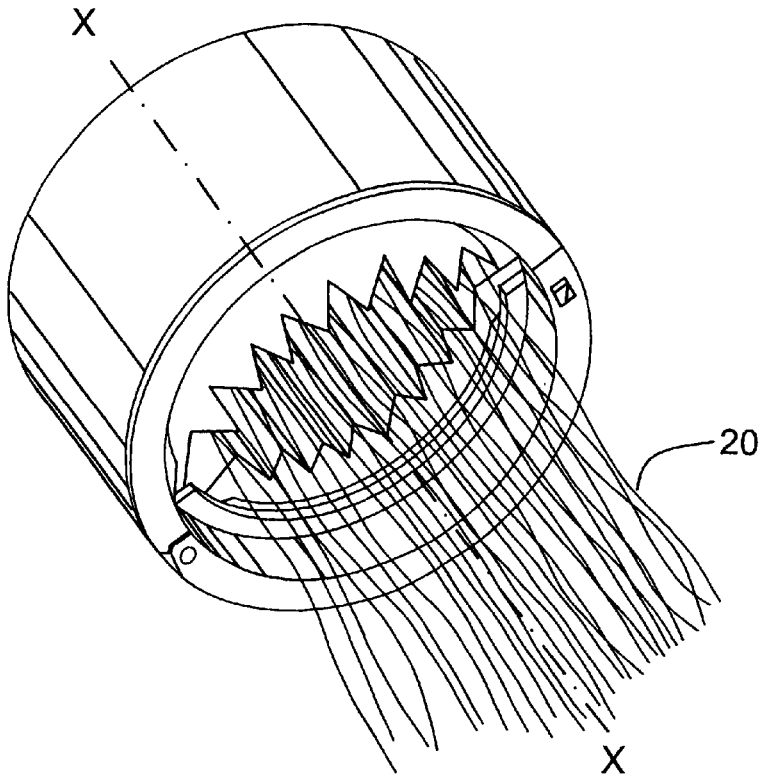
FIG. 2 is a perspective view of the ponytail holder of FIG. 1 in the closed condition, gripping a bunch of hair.

FIGS. 1–6 show the first preferred embodiment of a ponytail holder according to the present invention. FIG. 1 shows ponytail holder 10 including a first rounded arm 11 with first formation 15, a second rounded arm 12 with second formation 17, a hinge 13, and a fastening mechanism 14. FIG. 1 further shows ponytail holder 10 open and about to clamp a bunch of hair 20. FIG. 2 shows ponytail holder 10 closed and clamping a bunch of hair 20. Returning to FIG. 1, fastening mechanism 14 includes latch 37 protruding from an end of the first arm, and a hook 38 located within an end of the second arm. The outer surfaces of the two rounded arms form a substantially cylindrical shape when the ponytail holder is closed. Preferably, the ponytail holder has a chamfer 39.

Figure 4:
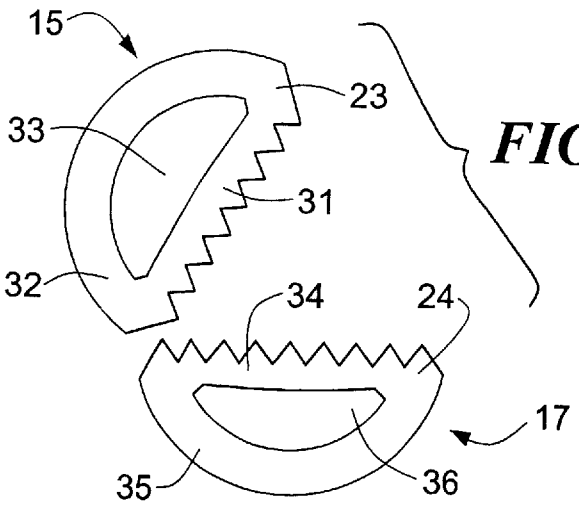
FIG. 4 is a side view of the two formations of the ponytail holder of FIG. 1.
Figure 3:
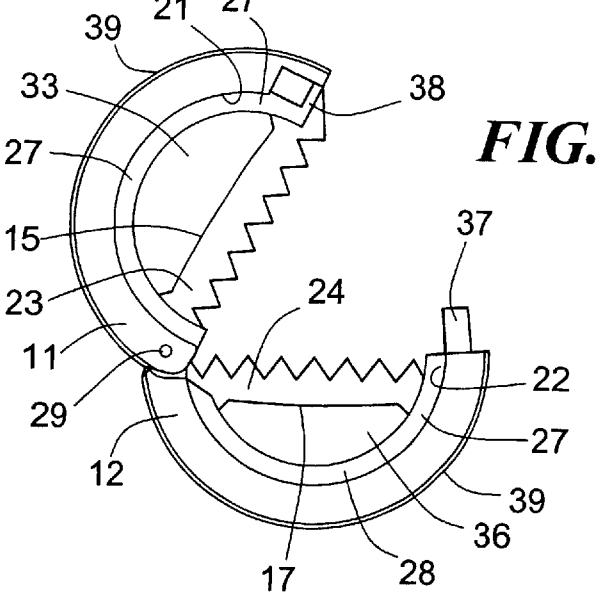
FIG. 3 is a side view of the ponytail holder of FIG. 1.

Referring to FIGS. 3 and 4, first formation 15 includes first elastic sling 31 defining a first row of non-slip rubber-type teeth 23, first curved supporting portion 32, and first shaped aperture 33. Aperture 33 is defined between the first elastic sling and the first supporting portion.

Second formation 17 includes second elastic sling 34 defining a second row of non-slip rubber-type teeth 24, second curved supporting portion 35, and second shaped aperture 36. Aperture 36 is defined between the second elastic sling and the second supporting portion.

Figure 6:
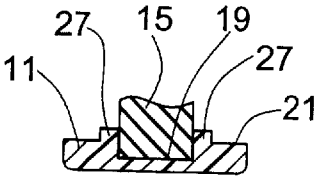
FIG. 6 is a cross-section at A—A of the ponytail holder shown in FIG. 5, showing two walls supporting one of the formations.
Figure 5:
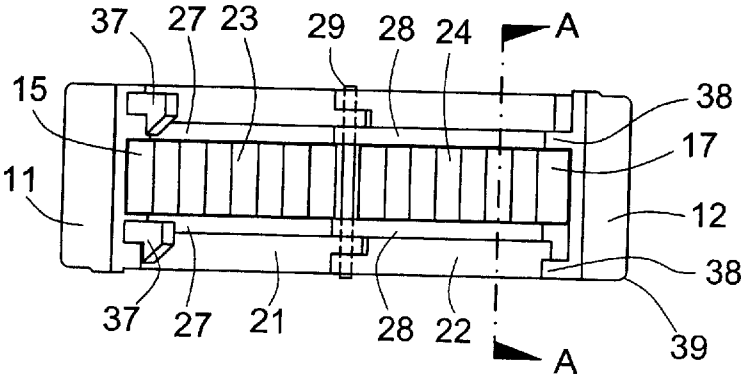
FIG. 5 is a top view of the ponytail holder of FIG. 1.

Referring to FIGS. 5 and 6, first formation 15 is supported by first walls 27 and first inner surface 21. First walls 27 form channel 19 between them. Likewise, second formation 17 is supported by second walls 28 and second inner surface 22.

The embodiment of FIGS. 1–6 is intended to hold firmly a plurality of hair strands worn as a ponytail, i.e., a bunch of hair having a cross section that is substantially circular. FIGS. 1 and 2 show how the elastic slings flex and the teeth are forced back to accommodate a thick bunch of hairs as in a ponytail. By virtue of the opposed elastic slings, the embodiment of FIGS. 1–6 accommodates a bunch of hair in a wide range of sizes.

FIGS. 1 and 2 each show the ponytail holder having two rows of intermeshing triangular shaped teeth, and a plurality of hair strands 20 running between the teeth. Each tooth has two planar sloping clamping faces 25 and a pointed linear apex 26. The apex of each tooth and the planar faces are aligned with the plurality of hair strands 20, and transverse to the length of the sling. Preferably, the pointed apex is relatively sharp. In preferred embodiments, the angle of the pointed apex is approximately 60°, and is generally in the range 30° to 90°.

Providing teeth with a relatively sharp pointed apex facilitates the even division of strands of hair. Providing teeth with planar sloping faces facilitates the even distribution of strands of hair over the non-slip rubber clamping faces. Providing teeth with sloping clamping faces increases the area of rubber in contact with strands of hair. This combination results in a more uniform distribution of hair and a more even application of force, thereby providing a ponytail holder that firmly holds fine hair in position.

Additionally, when a large bunch of hair pushes the gripping surfaces back, the facing faces of adjacent teeth of the same sling close in on hair at the periphery of the bunch in a squeezing action to grip hair at the periphery more tightly. In this way a large bunch of hair is gripped tightly. Furthermore, when a small bunch of hair is enclosed by the ponytail holder, portions of the small bunch of hair are gripped tightly between the facing faces of the intermeshing teeth of opposing slings. In this way a small bunch of hair is gripped tightly.

Figure 10:
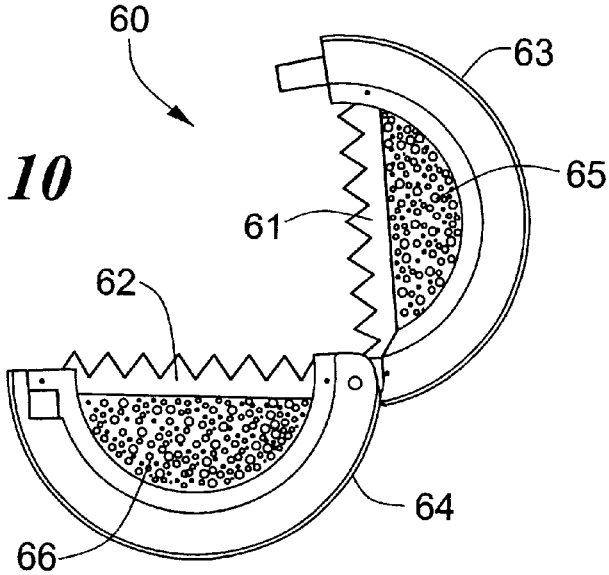
FIG. 10 is a side view in the open condition of a third embodiment, the ponytail holder having non-slip rubber-type elastic slings with teeth, each sling supported by an open cell plastic foam structure.

Formations 15 and 17, as shown in FIG. 4, include shaped apertures 33 and 36, respectively, to increase the effective resiliency of the teeth. For example, the size and shape of the shaped aperture may be selected to be more rounded or narrower, to control effective resilience along the length of a row of teeth. In a preferred embodiment, the formation and the teeth are all of one material. However, as illustrated in FIG. 10, the formation may include a teeth portion and a base portion made of different materials.

Each row of teeth is preferably part of a single formation of non-slip rubber-type material formed on a specially designed mold. In the preferred embodiment, the non-slip rubber-type material is a silicone rubber of durometer value in the range 10–50, and preferably about 30. Silicone rubber of this type is available from GE Silicones, 260 Hudson River Road, Waterford, N.Y. 12188, USA. However, the teeth may be constructed of any non-slip rubber-type material.

The embodiments of FIGS. 1–14 are intended to hold a relatively thick plurality of hair strands worn as a ponytail. Accordingly, for both practical and aesthetic reasons, the clip itself generally forms the shape of a cylinder. However, since the hair clip is worn as apparel, its visible surfaces may be shaped and/or ornamented in a variety of ways to provide a decorative appearance. Thus, the term "a substantially cylindrical shape" herein refers to any generally circular shape capable of enclosing a bunch of hair in a ponytail.

Figure 7:
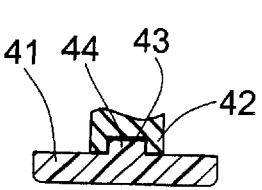
FIG. 7 shows one wall supporting one of the formations.

An alternative wall structure is shown in FIG. 7. In this version, curved portion 42 of the formation has a peripheral groove 43, and each inner surface 21 includes a single wall 44 that fits into the groove.

Figure 8:
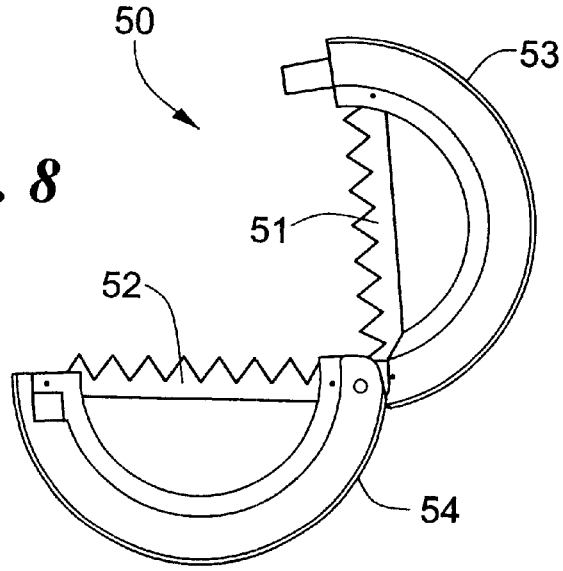
FIG. 8 is a side view of a second embodiment, the ponytail holder shown in the open condition having pre-stressed non-slip rubber-type strip elastic slings with teeth, each sling held under tension at its ends.
Figure 9:
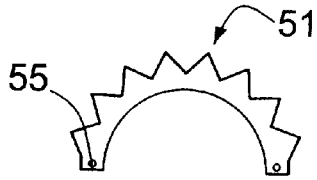
FIG. 9 shows an elastic sling of the embodiment of FIG. 8, as molded.

A second embodiment 50 is shown in side view in FIG. 8. This second embodiment includes pre-stressed non-slip rubber-type elongated first and second elastic slings 51 and 52. First and second slings are supported at each end by pivotal attachment to the ends of arms 53 and 54, respectively. The spring-like quality of the thick strip of rubber of the second embodiment provides the necessary force to hold tightly a plurality of hairs as in a ponytail. FIG. 9 shows molded sling 51 of the second embodiment with a convex gripping surface, teeth, and hole 55 for an anchor pin (not shown). Alternatively, the formations may be made of a rubber-type material molded over a corrugated spring-like support member (not shown), the support member being attached at its ends pivotally, fixedly, or flexurally to the arms.

A third embodiment 60 is shown open in FIG. 10 in side view. This embodiment uses first and second elastic slings 61 and 62, backed by open cell plastic foam 65 and 66, respectively. The foam is supported by the inner surface of a corresponding arm.

Figure 11:
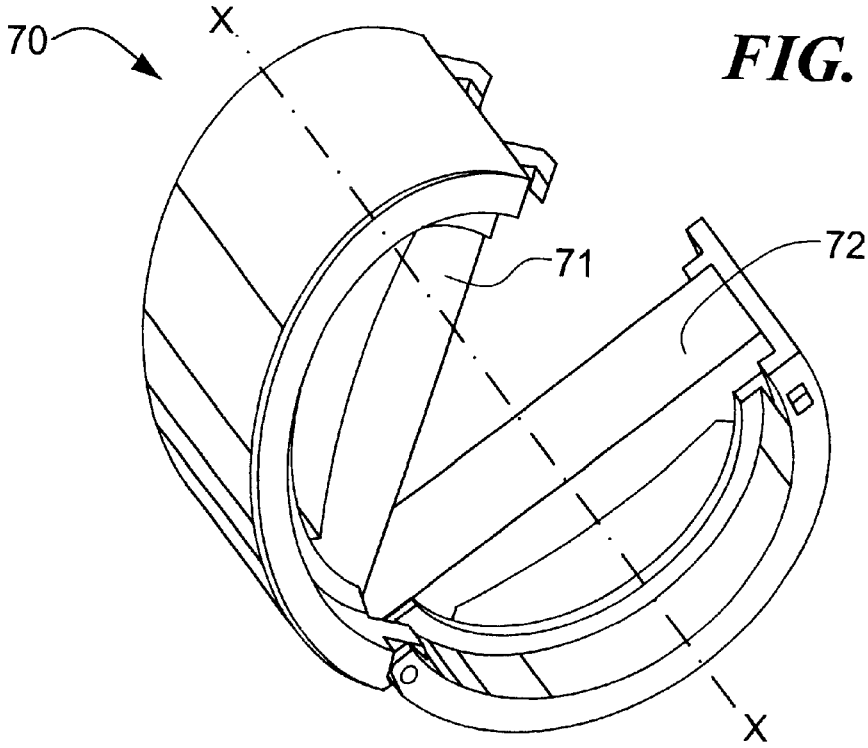
FIG. 11 is a perspective view of a fourth embodiment, the ponytail holder shown in the open condition, having bridge-type elastic slings with flat non-slip rubber-type gripping surfaces.

A fourth embodiment 70, of a ponytail holder according to the present invention, is shown open in perspective view in FIG. 11. This embodiment is similar to the first embodiment, except that elastic slings 71 and 72 have a flat gripping surface, i.e., no teeth.

Figure 12:
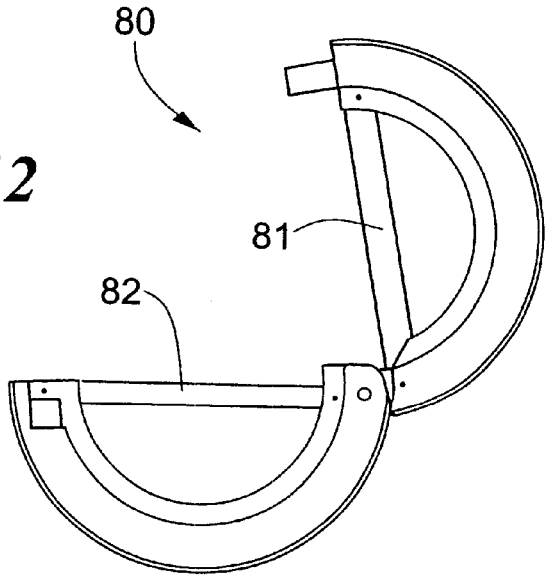
FIG. 12 is a side view of a fifth embodiment, the ponytail holder shown in the open condition, having elastic slings with a flat pre-stressed non-slip rubber-type strip gripping surface, each sling supported at its ends.
Figure 13:
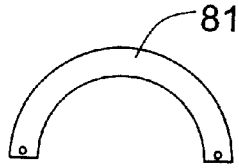
FIG. 13 shows a sling of the embodiment of FIG. 12, as molded.

A fifth embodiment 80 is shown open in side view in FIG. 12. This embodiment has elastic slings 81 and 82, each with a pre-stressed elastic sling having a flat gripping surface, each formation stretched between support points at its ends. FIG. 13 shows elastic sling 81 of the fifth embodiment as molded with a convex gripping surface and no teeth.

Figure 14:
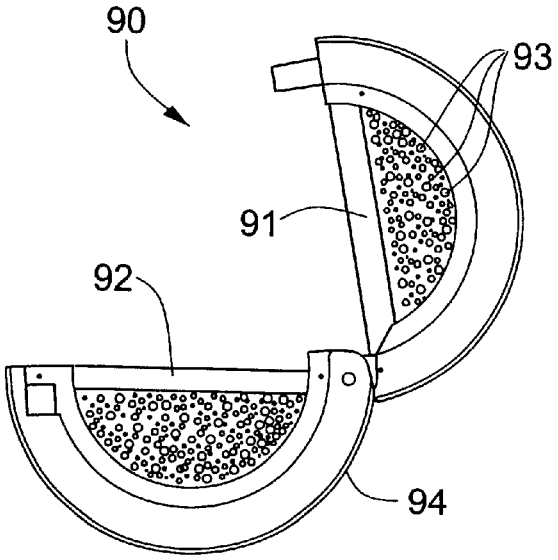
FIG. 14 is a side view of a sixth embodiment, the ponytail holder in the open condition, each sling having a flat gripping surface and supported by open cell plastic foam.

A sixth embodiment 90 is shown open in FIG. 14 in side view. This embodiment uses flat-surface first and second elastic slings 91 and 92, each backed by open-cell plastic foam structure 93 and 94, each foam structure cradled by an arm.

Figure 15:
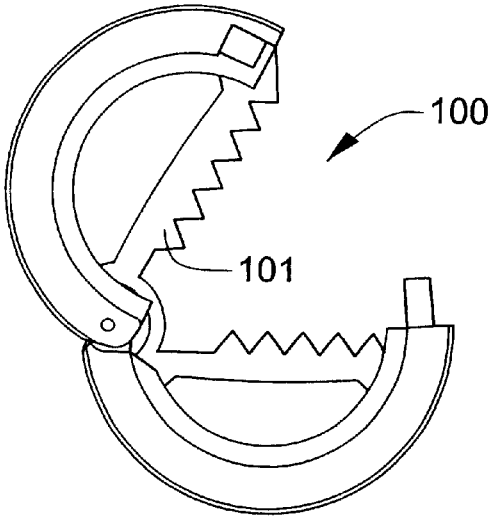
FIG. 15 is a side view of a seventh embodiment having a single formation defining two elastic sling portions.
Figure 16:
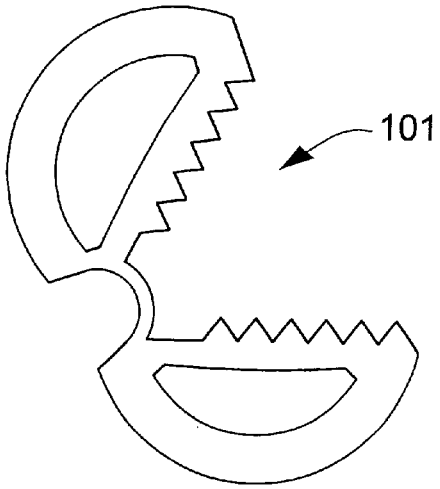
FIG. 16 shows the single formation of the embodiment of FIG. 15.

A seventh embodiment 100 is shown open in FIG. 15 in side view, the ponytail holder in the open condition. This embodiment uses a single formation defining two elastic sling portions having teeth. The single formation 101 of the seventh embodiment is shown in FIG. 16.

Figure 17:
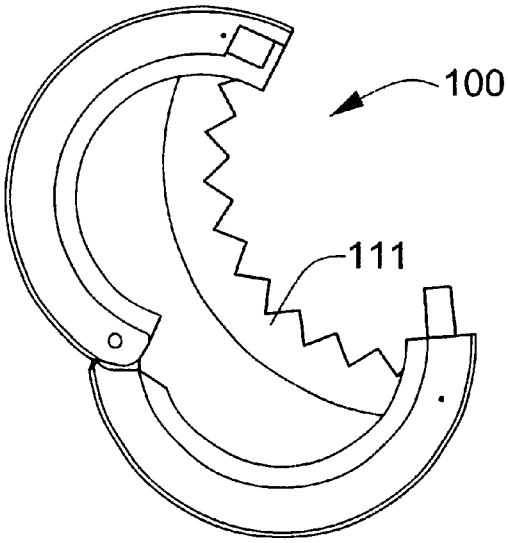
FIG. 17 is a side view of an eighth embodiment having a single formation defining one elastic sling portion bridging the inner surfaces of both arms.
Figure 18:
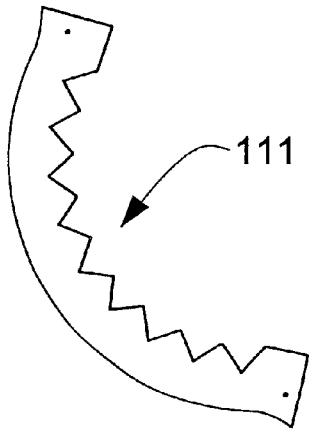
FIG. 18 shows the single formation of the embodiment of FIG. 17.

An eighth embodiment 110 is shown open in FIG. 17 in side view, the ponytail holder in the open condition. This embodiment uses a single formation defining one elastic sling having teeth. The one elastic sling bridges the inner surfaces of the first and second arms. Formation 111 of the eighth embodiment is shown in FIG. 18.

Figure 19:
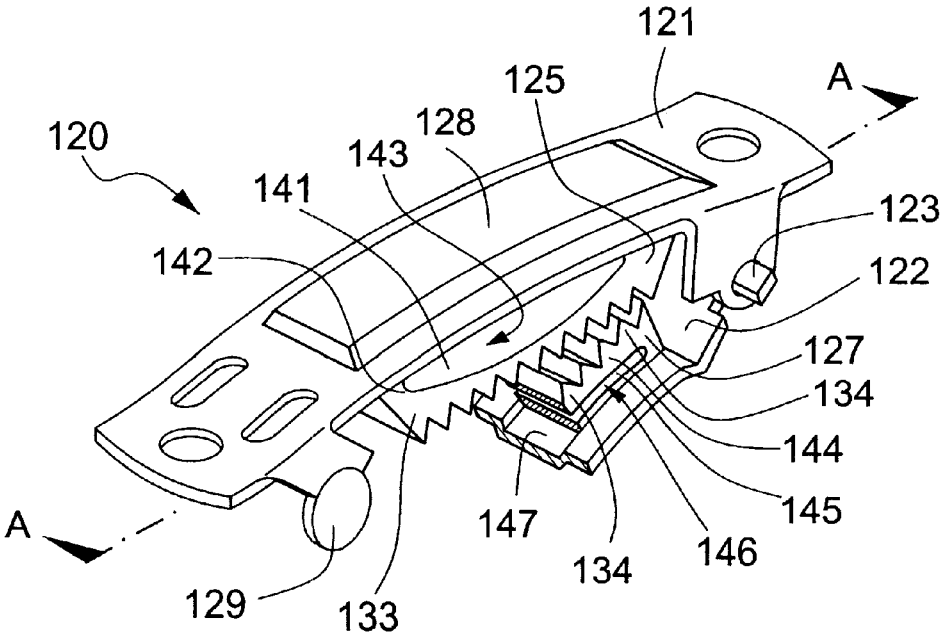
FIG. 19 is a partial cut-away perspective view of a ninth embodiment, a barrette-style ponytail holder having two formations, each defining an elastic sling.
Figure 20:
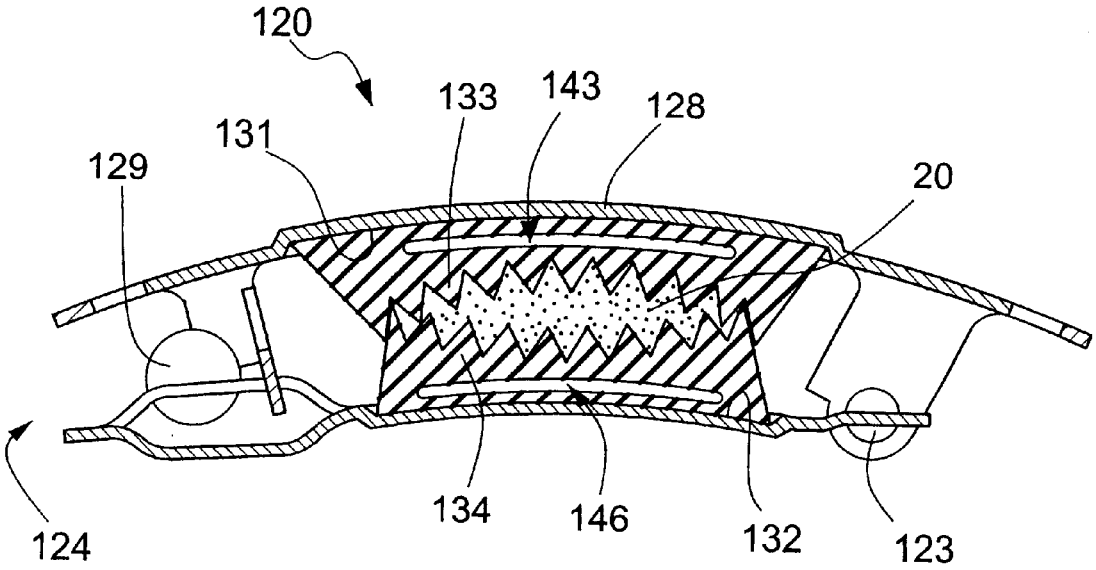
FIG. 20 is a cross section view of the ponytail holder of FIG. 19 in the closed condition, gripping a bunch of hair.

A ninth embodiment 120 is shown in FIGS. 19–22. FIG. 19 is a partial cut-away perspective view of a barrette-style ponytail holder 120 in the open condition. FIG. 20 shows ponytail holder 120 in the closed condition and clamping a bunch of hair 20. This embodiment has two formations, each defining an elastic sling portion, a shaped aperture, and a curved supporting portion.

Ponytail holder 120 includes a first arm 121 with first formation 125, a second arm 122 with second formation 127, a hinge 13, and a fastening mechanism 124. (Fastening mechanism 124 is shown in side view, in FIG. 19. It is not fully shown in FIG. 20 because of the cut-away). Fastening mechanism 124 is a conventional barrette fastening mechanism having squeeze tabs 129.

First formation 125 includes first elastic sling portion 141 defining a first row of non-slip rubber-type teeth 133, first curved supporting portion 142, and first shaped aperture 143. Shaped elongated aperture 143 is defined between the first elastic sling portion and the first supporting portion. Second formation 127 includes second elastic sling 144 defining a second row of non-slip rubber-type teeth 134, second curved supporting portion 145, and second shaped aperture 146. Aperture 146 is defined between the second elastic sling and the second supporting portion.

Figure 21:
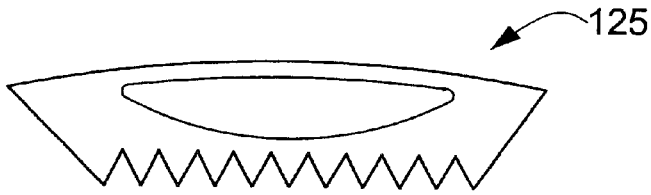
FIG. 21 shows the formation of the embodiment of FIG. 19.
Figure 22:
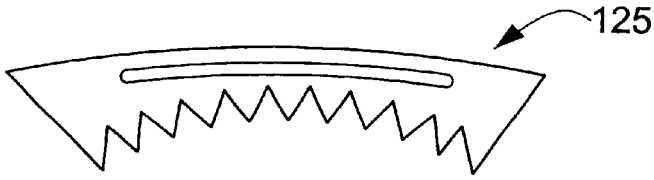
FIG. 22 shows the formation of the embodiment of FIG. 19 as deformed when the ponytail holder is closed and gripping a bunch of hair.

Formation 125 is shown in side view in FIG. 21. Formation 125 is shown in FIG. 22 as deformed when the ponytail holder is closed and gripping a bunch of hair.

First formation 125 is supported by the walls of a channel (not shown) defined on the inner surface of first arm 121 opposite raised area 128. The channel supports first formation 125. Likewise, the second formation is supported by the walls of channel 147 formed in the inner surface 122 of the second arm. The embodiment of FIGS. 19–22 is intended to hold firmly a bunch of hair in a wide range of sizes. FIGS. 20 and 22 show how the aperture is compressed and the teeth are forced back to accommodate a thick bunch of hairs. Each formation is attached to the inner surface of its arm (inner surfaces 131 and 132) over its length.

Because the opposed elastic slings are able to move back, the embodiment of FIGS. 19–22 accommodates a bunch of hair in a wide range of sizes. Aperture 143 is wider at its center than it is at its edges. This enables the teeth to move back further in the center to define a more round shape. It also enables adjacent faces of teeth nearer the center to move toward each other slightly when gripping a thick bunch of hair, thereby closing in on hair at the periphery of the bunch in a squeezing action to grip hair at the periphery more tightly.

An alternative embodiment (not shown) to the ninth embodiment of FIGS. 19–22, includes a more rounded first arm 121, and a substantially straight second arm 122, wherein second arm 122 supports a formation having no aperture. This provides a semi-circular shaped ponytail holder.

The present application is a continuation-in-part application that claims priority to co-pending application Ser. No. 09/452,791, filed Dec. 2, 1999. Application Ser. No. 09/452,791 is hereby incorporated herein by reference.

What is claimed is:

1. A ponytail holder, comprising:

a hinged pair of first and second arms movable between an open position and a closed position, each arm having a hinged end and an opposite end, the first and second arms having inner surfaces;

fastening means, located at the opposite ends, for releasably fastening the arms in the closed position; and first and second non-slip rubber-type formations, at least one formation defining an elastic sling having a non-slip gripping surface, the sling supported at a hinged end and an opposite end to bridge an inner surface.

2. A ponytail holder according to claim 1, wherein each formation includes an elastic sling portion and a supporting portion, and each formation defines a shaped aperture located between its sling portion and its supporting portion.

3. A ponytail holder according to claim 2, wherein the two arms make a substantially cylindrical shape in the closed position, each inner surface is concave, and each formation is formed as one piece having a D-shaped structure.

4. A ponytail holder according to claim 3, wherein the shaped aperture is a D-shaped aperture, wider at its center than it is at its ends.

5. A ponytail holder according to claim 2, wherein each inner surface includes a retaining wall for retaining a supporting portion.

6. A ponytail holder according to claim 1, wherein the gripping surface defines a row of triangular shaped non-slip rubber-type teeth.

7. A ponytail holder according to claim 6, wherein the teeth of the first formation are in an offset interlocking mating relationship with the teeth of the second formation; such that a thin bunch of hair may be interlock-gripped between mating faces of opposed formations, and a thick bunch of hair may be squeeze-gripped between adjacent faces of one formation; whereby the ponytail holder accommodates a bunch of hair over a wide range of bunch thickness, and holds the bunch of hair firmly.

8. A ponytail holder according to claim 1, wherein each formation is an elongate structure defining an elastic sling, and wherein ends of each elastic sling are attached to a hinged end and an opposite end to bridge one inner surface.

9. A ponytail holder according to claim 8, wherein each sling is held in tension across an inner surface.

10. A ponytail holder according to claim 9, wherein each sling is formed as a curved structure.

11. A ponytail holder according to claim 8, wherein each formation defines a row of triangular shaped teeth, the teeth of the first formation in an offset interlocking mating relationship with the teeth of the second formation; such that a thin bunch of hair may be interlock-gripped between mating faces of opposed formations, and a thick bunch of hair may be squeeze-gripped between adjacent faces of one formation; whereby the ponytail holder accommodates a bunch of hair over a wide range of bunch thickness, and holds the bunch of hair firmly.

12. A ponytail holder according to claim 11, further comprising a foam cushion located between a formation and an associated inner surface.

13. A ponytail holder according to claim 1, wherein the two arms are substantially straight, and the at least one formation defines an elongated elastic sling portion with a slightly convex gripping surface, an elongated substantially straight aperture, and an elongated substantially straight support portion.

14. A ponytail holder according to claim 13, wherein the support portion is channel-mounted to the inner surface.

15. A ponytail holder according to claim 13, wherein the aperture is wider at its center than it is at its ends.

16. A ponytail holder, comprising:

a hinged pair of first and second arms movable between an open position and a closed position, each arm having a hinged end and an opposite end, the first and second arms having inner surfaces;

fastening means, located at the opposite ends, for releasably fastening the arms in the closed position; and a non-slip rubber-type formation defining an elastic sling having a non-slip gripping surface, the sling end-supported to bridge both inner surfaces;

wherein the gripping surface defines a row of triangular shaped non-slip rubber-type teeth;

such that a bunch of hair may be squeeze-gripped between faces of adjacent teeth;

whereby the ponytail holder accommodates a bunch of hair over a wide range of bunch thickness, and holds the bunch of hair firmly.

* * * * *